US005417486A

United States Patent [19]

Manlove

[11] Patent Number: 5,417,486

[45] Date of Patent: May 23, 1995

[54] BRAKE WEDGE FOR RAIL MOUNTED CABINETS

[76] Inventor: James Manlove, 306 W. Main St., Morris, Ill. 60450

[21] Appl. No.: 83,724

[22] Filed: Jun. 25, 1993

[51] Int. Cl.[6] ..... A47B 53/00

[52] U.S. Cl. ..... 312/201; 104/257; 188/36; 188/4 R; 312/198

[58] Field of Search ..... 312/201, 198, 199, 249.1, 312/249.8, 107, 301; 104/257, 258, 259; 188/35, 36, 32, 4 R, 37

[56] References Cited

U.S. PATENT DOCUMENTS

| | | | |
|---|---|---|---|
| 502,145 | 7/1893 | Sears . | |
| 537,295 | 4/1895 | Kranich | 188/36 |
| 551,210 | 12/1895 | Kurtz . | |
| 556,949 | 3/1896 | Wheeler et al. | 188/36 |
| 577,044 | 2/1897 | Leaycraft . | |
| 588,255 | 8/1897 | Wheeler . | |
| 594,698 | 11/1897 | Hite . | |
| 599,471 | 2/1898 | Neracher . | |
| 806,849 | 12/1905 | Shue | 188/36 |
| 1,279,254 | 9/1918 | Carlson | 188/36 |
| 1,386,242 | 8/1921 | Dixon . | |
| 1,804,184 | 12/1929 | Segal . | |
| 2,062,184 | 11/1936 | Loehnis et al. . | |
| 2,166,704 | 7/1939 | Foulkes | 312/201 |
| 2,522,104 | 9/1950 | Edwards | 188/32 |
| 3,967,868 | 7/1976 | Baker, Jr. . | |
| 4,017,131 | 4/1977 | Camenisch . | |
| 4,119,376 | 10/1978 | Moyer | 312/198 |
| 4,437,711 | 3/1984 | Dahnert | 312/198 |
| 4,557,534 | 12/1985 | Dahnert | 312/198 |
| 4,616,888 | 10/1986 | Peterman | 312/201 |

FOREIGN PATENT DOCUMENTS

| | | | |
|---|---|---|---|
| 2063837 | 6/1981 | United Kingdom | 312/201 |
| 2225928 | 6/1990 | United Kingdom | 312/201 |

*Primary Examiner*—Kenneth J. Dorner
*Assistant Examiner*—Janet M. Wilkens

[57] ABSTRACT

A brake wedge for rail-mounted cabinets which allows the movement of the cabinets to be automatically or manually prevented. The cabinet includes a number of wheels which are guided by floor-supported rails. The brake wedge has a curved profile and is operably connected to an actuating mechanism. The wedges are positioned adjacent each wheel of the cabinet and slightly above the rails. When the actuating mechanism is engaged by an object, one or more of the brake wedges are forced toward the wheels, causing the curved profile of the brake wedges to frictionally engage the wheels and thereby prevent further rotational movement of the wheel. A spring biases the actuating mechanism to an outward or normal position. The actuating mechanism, which defines an outer surface or portion of the base section, is preferably at or slightly above floor level and is thereby engaged and operated by virtually any object on the floor, such as a box or a person's foot.

19 Claims, 3 Drawing Sheets

BRAKE WEDGE FOR RAIL MOUNTED CABINETS

BACKGROUND OF THE INVENTION

1. Field of the Invention

The present invention generally relates to rail or track-mounted cabinets and, more particularly, to brake mechanisms for such cabinets.

2. Description of Related Art

Rail or track-mounted cabinets have been created and developed to maximize storage space while allowing easy access to stored articles. As such, the cabinets are movable between a collapsed or abutting configuration wherein adjacent cabinets contact one another and an extended or spaced-apart configuration wherein adjacent cabinets are spaced a distance from each other to permit access to the articles stored within the cabinets.

Conventionally, the cabinets include base sections which have a number of rail-engaging wheels. The wheels are guided by the rails, and permit the cabinets to move back-and-forth between the abutting and the spaced-apart configurations.

When the cabinets are spaced-apart, users walk between adjacent cabinets to remove articles therefrom and place articles thereon. It is common for users to temporarily store or place articles on the support surface or floor between the spaced-apart cabinets. While one user is between the spaced-apart cabinets, or while an article is on the floor between the spaced-apart cabinets, a second user may attempt to return the spaced-apart cabinets to the abutting configuration in order to gain access to a different set of adjacent cabinets. This results in embarrassment and confusion for one or both users. Also, if there are delicate articles on the floor, compression between the cabinets may cause permanent damage.

Therefore, there exists a need in the art for a track or rail-mounted cabinet whose movement is automatically stopped when an obstruction is encountered. There also exists a need in the art for a cabinet which is selectively prevented from moving toward an adjacent cabinet.

SUMMARY OF THE INVENTION

The present invention provides a rail-mounted cabinet whose movement is automatically prevented when an obstruction is encountered. In accordance with the present invention, a cabinet having a base section adapted to move along a generally straight path is provided. The base section includes a wheel and means for selectively preventing rotation of the wheel. The rotation-preventing means includes a wheel-engaging member and an actuating mechanism.

In further accordance with the present invention, the actuating mechanism is operable to move the wheel-engaging member between a first position spaced from a wheel, and a second position abutting the wheel. The wheel-engaging member permits free rotation of the wheel when in the first position, while preventing rotation when in the second position. The actuating mechanism is provided by the base section of the cabinet at a front and rear side of the cabinet and is adapted to control movement of the cabinet in a direction normal to the front and rear sides.

In further accordance with the present invention, the cabinet is adapted to mount on a plurality of rails. The base section provides one or more wheels for each rail.

Each of the wheels is provided with a wheel-engaging member and one or more actuating mechanisms.

In further accordance with the present invention, a series or array of movable cabinets are provided. Each of the cabinets include a base section which allows movement in a direction normal to front and rear sides of the cabinets between a compressed or abutting configuration wherein adjacent cabinets engage or abut one another and a spaced-apart configuration wherein adjacent cabinets are spaced a distance from each other. Each of the base sections include one or more movement-preventing means which are adapted to prevent motion of a cabinet from the spaced-apart configuration to the abutting configuration when an object or obstruction between adjacent cabinets is engaged by the movement preventing means.

BRIEF DESCRIPTION OF THE DRAWINGS

The present invention will be further described herein with reference to the following description and drawings, wherein.

DETAILED DESCRIPTION OF THE PREFERRED EMBODIMENT

Figure 1:
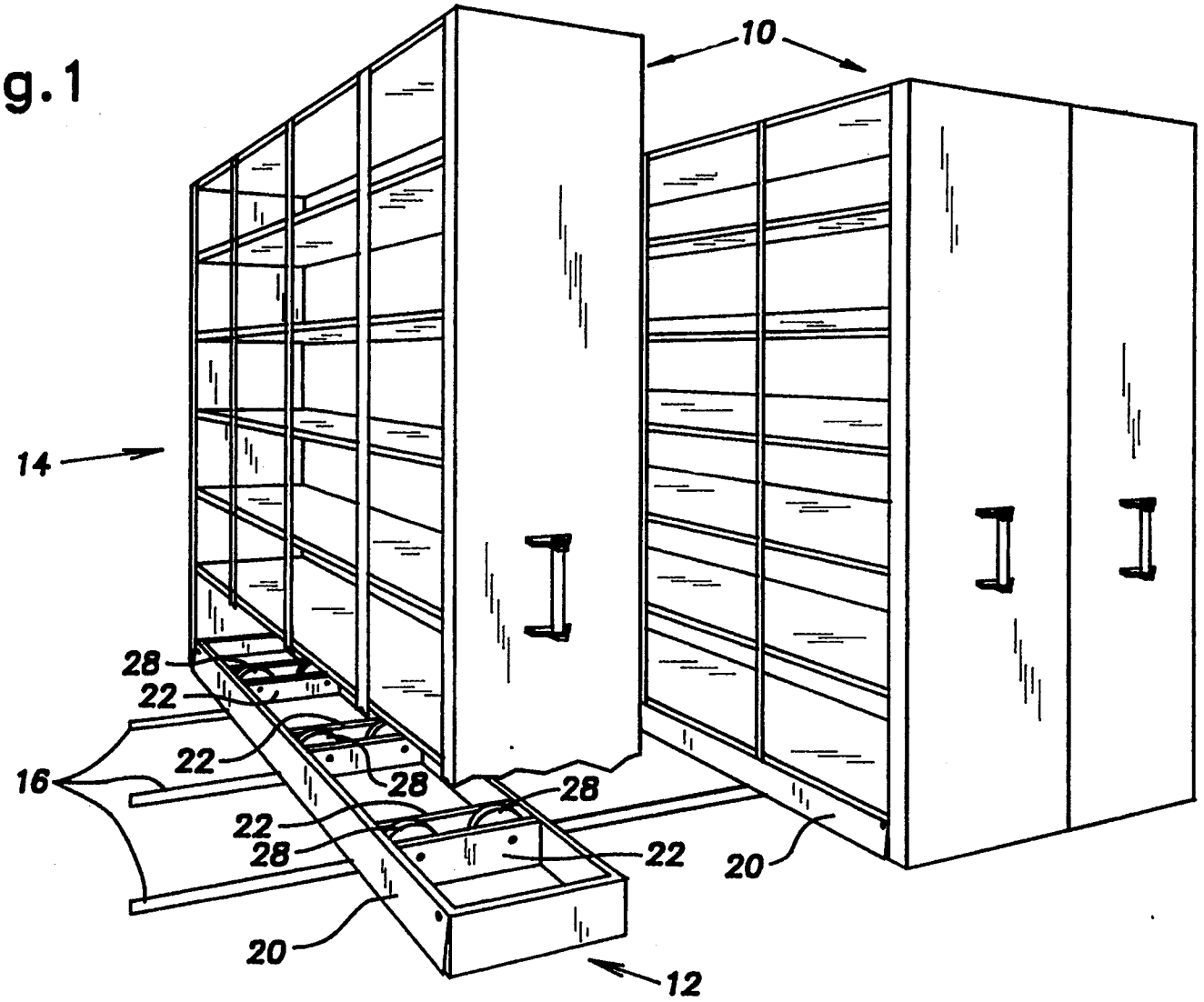
FIG. 1 is a perspective view of a series of rail-mounted cabinets in accordance with the present invention.

With reference to the drawing figures and, in particular, FIG. 1, a series of cabinets 10 incorporating the present invention is shown. The cabinets 10 include a base section 12 and an upper article receiving section 14. The base section 12 is movably mounted upon a series of rails 16. In the illustrated and preferred embodiment three rails are provided. However, any number of rails can be used depending upon the size of the cabinets 10 and the weight that they are anticipated to support.

The cabinets 10 are movable along the rails 16 between an abutting configuration and a spaced-apart configuration, as illustrated in FIG. 1. When in the spaced-apart configuration a user can walk between the cabinets and gain access to articles stored thereon. When in the abutting configuration, the floor space required by the cabinets 10 is minimized. Thus, the cabinets 10 will normally be in the abutting configuration, particular adjacent pairs of cabinets being moved to the spaced-apart configuration only when access to articles stored therein is desired.

Figure 2:
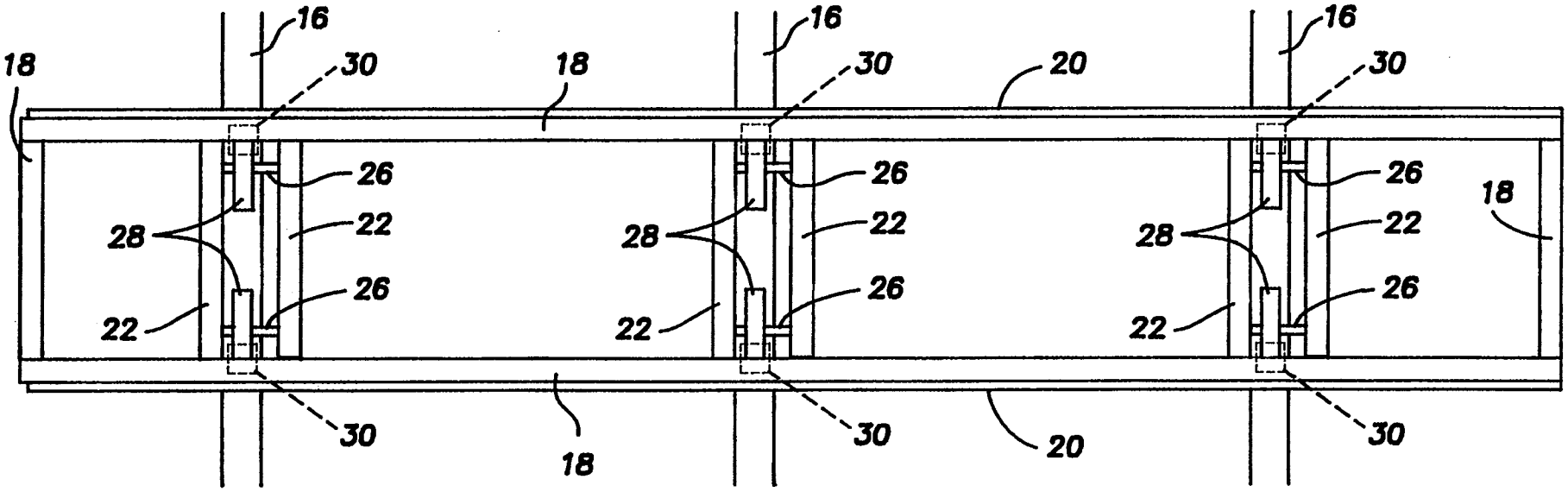
FIG. 2 is a top plan view of a cabinet base section in accordance with the present invention.
Figure 4:
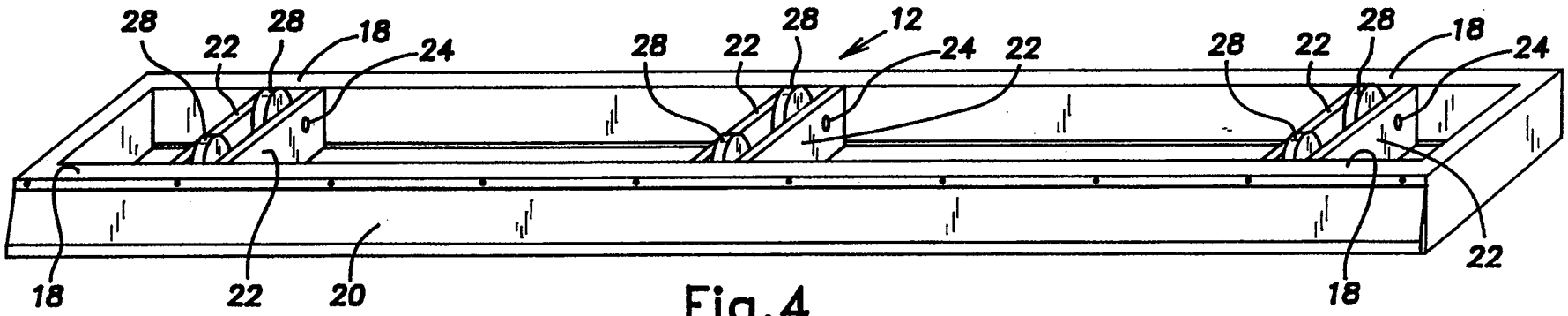
FIG. 4 is a top perspective view of the cabinet base section in accordance with the present invention.
Figure 3:
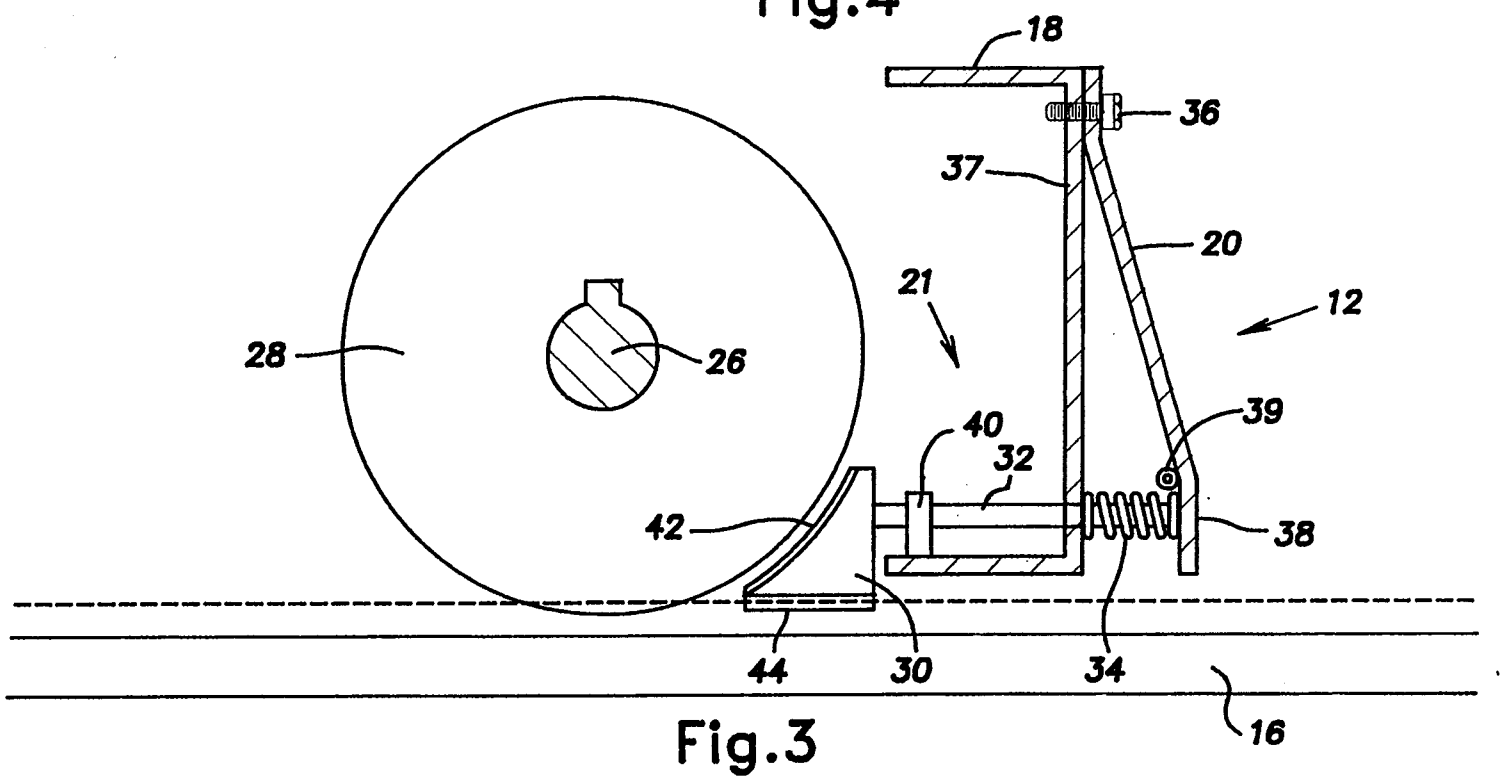
FIG. 3 is a side cross-sectional view of a braking mechanism and wheel provided by the cabinet base section in accordance with the present invention.

With reference to FIGS. 2–4, the base section 12 of one of the cabinets 10 is illustrated. The base section includes a supporting framework or surface 18 upon which the upper article-receiving section 14 of the cabinet rests. The base section 12 includes front and rear sides which each include a panel 20 which extends outwardly and downwardly therefrom. The panel 20 defines an outer surface of the base section 12 and acts as an actuator for a braking mechanism 21, as will be described more fully hereafter.

A series of cover members 22 extend between the front and rear sides of the base section 12, and partially conceal and protect the braking mechanism which is housed therein. The cover members 22 include lateral openings 24 which vertically support axles 26 for wheels 28 which ride within and are guided by the rails 16.

With particular reference to FIGS. 2 and 3, the braking mechanism 21 and its relationship to the wheels 28 is illustrated. The braking mechanism 21 includes the actuator or panel 20, a braking wedge 30, an actuating member or rod 32, and a biasing spring 34.

The panel 20 is attached by a conventional fastener such as a screw 36 to a face portion 37 of the base section 12. Preferably, the panel 20 is formed of bent sheet metal, and outwardly diverges from the face of the base section. A lower portion 38 of the panel 20 provides an inner surface against which the spring 34 and a distal or outer end of the actuating member 32 bear.

The actuating member or rod 32 extends between the inner surface of the lower portion 38 of the panel 20 and a rear of the braking wedge 30. The base section 12 includes a brace or support 40 to vertically support the actuating member or rod 32. A proximal end of the actuating member 32 engages the braking wedge 30. The distal or outer end of the actuating member or rod 32 extends through the spring 34 and is in contact with inner surface of the lower portion 38 of the panel 20, as discussed previously.

The spring 34 is trapped between the lower portion 38 and the face portion 37 of the base section 12. The spring 34 biases the panel 20 to an outer position wherein the panel is spaced from the front face 37. Optionally, a spring clip or C-clip 39 helps retain the spring 34 relative to the panel 20 and the actuating member 32.

The braking wedge 30 has an arcuate or curved surface 42 which is designed and shaped to generally match the contour of the wheel 28 adjacent thereto. Preferably, the curved surface 42 is formed of a rubber-like material which enhances or stimulates frictional engagement between the wedge 30 and the wheel 28. The braking wedge 30 is carried slightly above and spaced from the rail 16. Optionally, the lower surface 44 of the wedge 30 can be formed of nylon or coated with a friction reducing material to allow the wedge 30 to freely slide along the rail 16.

The braking wedge 30 is connected to the actuating member 32 and is adapted to move rearwardly (toward the wheel) in accordance with movement of the actuator or panel 20.

The operation of the braking mechanism 21 of the present invention will be described hereafter with reference to the foregoing description and drawings.

The cabinets 10 are manually movable between the abutting and the spaced apart configurations. When in the spaced-apart configuration, the upper article supporting sections 14 of spaced-apart cabinets are accessible. While one user is between the spaced-apart cabinets, or while an article is on the floor between the cabinets, a second user may attempt to return the cabinets to the abutting configuration in order to gain access to a different pair of adjacent cabinets.

As the cabinets move toward each other, the foot of the user therebetween, or the floor-supported article, contacts the actuator or panel 20, and moves it toward the wheel 28 against the bias of the spring 34. Movement of the panel causes the actuating member or rod 32 to force the braking wedge 30 toward the wheel 28, thereby causing the curved frictional surface 42 to engage the wheel 28.

Engagement of the wheel 28 with the curved surface 42 of the braking wedge 30 prevents the wheel from further rotating, and stops the spaced-apart cabinets from moving toward each other (i.e., toward the abutting configuration). When the second user stops urging the spaced-apart cabinets toward the abutting configuration, the wheel 28 will roll away from the braking wedge 30, and the panel 20 will move away from the face 37 of the base section under the bias of the spring 34. Preferably, and as illustrated, there are actuators or panels 20 on the front and rear sides of the cabinet base section 12 to prevent movement normal to the front and rear sides along the rails 16.

The braking mechanism 21 of the present invention described herein is a fully mechanical, passive system which prevents over-compression of an article or user. The threshold force which must be overcome prior to operation of the braking mechanism is adjustable by varying the strength of the coil biasing spring, and can be selected so that articles will not be damaged by compression between the cabinets prior to actuation of the braking mechanism. The braking mechanism, although it can be selectively operated or actuated by a user, is designed to operate automatically, is fully concealed, and does not interfere with the normal operation and use of the cabinets. The braking mechanism 21 automatically returns to its inactive state (FIG. 3) when force or pressure thereon is removed.

Although the braking mechanism has been described herein for use with a manual or un-powered rail mounted cabinet system, it is contemplated that the braking mechanism of the present invention could be incorporated into a power driven cabinet system. Moreover, although a pair of wheels are shown for each rail, any number of wheels are contemplated for use with each rail. For example, a single wheel could be used with each rail and have a pair of braking mechanisms associated therewith. Moreover, the coil spring 34 used herein could be replaced by any type of biasing member. For example, the bent panel 20 could inherently provide a spring or biasing means which will tend to maintain the panel spaced from the face portion 37 of the base section 12. Hence, while the preferred embodiment of the present invention is shown and described herein, it is to be understood that the same is not so limited but shall cover and include any and all modifications thereof which fall within the purview of the invention as defined by the claims appended hereto.

What is claimed is:

1. A cabinet having a base section and an article receiving section, said base section defining a support upon which said article receiving section is mounted and comprising a front panel, a rear panel, a wheel and means for selectively preventing rotation of said wheel, wherein the wheel is mounted for rotation intermediate said front and rear panels and is adapted to move along a generally straight path, said rotation preventing means comprising a wheel engaging member and an actuating mechanism, said actuating mechanism including an actuator mounted to said front panel and being operable to move between a normal position spaced from said front panel and an actuated position relatively closer to said front panel and thereby moving said wheel engaging member between a first position spaced from said wheel and a second position abutting said wheel to prevent rotation thereof.

2. A cabinet as recited in claim 1, wherein the article receiving section includes a series of article receiving spaces which are accessible from a front side thereof, the actuating mechanism provided by the base section controlling movement of the cabinet in a direction normal to the front side.

3. A cabinet as recited in claim 1, further comprising a plurality of actuating mechanisms, wheel engaging members, and wheels, each of said wheels being operably associated with one or more wheel engaging members and one or more actuating mechanisms which cooperate to prevent rotation of said wheel when the one or more actuating mechanisms engage an obstruction.

4. A cabinet as recited in claim 1, wherein the wheel is operably guided by a rail and the wheel engaging member comprises a brake wedge, said brake wedge being carried by the base section slightly above the rail and adjacent the wheel and having a surface which is adapted to frictionally engage the wheel, said brake wedge being movable between a position wherein said wheel engaging surface is spaced from said wheel and a position wherein said wheel engaging surface engages the wheel and prevents rotation thereof.

5. A cabinet as recited in claim 1, wherein the actuator defines an exterior portion of the base section, said actuating mechanism including an actuating member extending from an inner surface of the actuator to the wheel engaging member, and means for biasing the actuator to said normal position.

6. A cabinet as recited in claim 5, wherein the actuating member extends through said front panel and engages said inner surface of said actuator.

7. A cabinet as recited in claim 6, wherein the wheel engaging member comprises a brake wedge, said brake wedge being supported by said actuating member adjacent the wheel and having a surface which is adapted to frictionally engage the wheel and prevent rotation thereof.

8. A cabinet as recited in claim 7, wherein said biasing means comprises a coil spring, said coil spring being placed over said actuating member and between said actuator and said front panel.

9. A cabinet as recited in claim 1, wherein there are a plurality of wheels, each of said wheels being operably associated with a guide rail and with the rotation preventing means to prevent rotation of said wheels when movement of the cabinet along the rails is obstructed.

10. A series of movable cabinets, each of said cabinets having front and rear sides and being adapted to move between an abutting configuration in which the front side of a first cabinet abuts the rear side of an adjacent cabinet to minimize space used by the cabinets and a spaced-apart configuration in which the front side of the first cabinet is spaced from the rear side of the adjacent cabinet to provide access to the cabinets, each of the cabinets providing a lower base section which comprises a front panel, a wheel, a wheel engaging member, and means for actuating said wheel engaging member, said wheel allowing the cabinets to move in a direction generally normal to the front and rear sides, said wheel engaging member comprising a brake wedge that provides a surface which frictionally engages the wheel under the influence of the actuating means to prevent rotation of said wheel, said actuating means comprising an actuator, an actuating member, and biasing means, said actuator being mounted to said front panel and defining an outer surface of the base section and being operable to move from a normal, outer position to an inner position against the action of the biasing means, said actuating member having a proximal end adjacent the brake wedge and a distal end adjacent an inner surface of the actuator, wherein when one of the cabinets is being moved and an object engages the actuator, the actuator moves inwardly against the action of the biasing means and forces the actuating member to move rearwardly which, in turn, forces the brake wedge to move into engagement with the wheel and prevent further movement of the cabinet toward the object.

11. A series of cabinets as recited in claim 10, wherein the biasing means is a coil spring which is mounted over the distal end of said actuating member.

12. A series of cabinets as recited in claim 11, wherein the coil spring is received between the inner surface of said actuator and said front panel.

13. A series of cabinets as recited in claim 10, wherein the brake wedge is supported by the actuating member slightly above and adjacent the wheel.

14. A series of cabinets as recited in claim 10, wherein there are a plurality of actuators, actuating members, brake wedges, and support surface mounted rails, said rails guiding the wheels and the cabinets for movement between the abutting and spaced apart configurations, said base section providing at least two wheels for each rail, each of said wheels being associated with at least one of said plurality of brake wedges, actuating members, and actuators which cooperate to prevent rotation of said wheel when the said at least one actuator engages an obstruction.

15. A series of cabinets as recited in claim 14, wherein the biasing means is a coil spring which is mounted over the distal end of said actuating member.

16. A series of cabinets as recited in claim 15, wherein the coil spring is received between the inner surface of the actuator said front panel.

17. A base section for a cabinet, comprising:

a support upon which an article receiving section of the cabinet may be mounted;

a wheel;

a front panel, a rear panel, and a pair of side panels;

an actuator attached to said front panel and movable between a normal position outwardly displaced from said front panel and an actuated position relatively closer to said front panel;

means for biasing said actuator toward said normal position;

a braking member adjacent said wheel and movable between an at-rest position spaced from said wheel and a braking position in contact with said wheel;

an actuating member having a proximal end attached to said braking member and a distal end adjacent said actuator.

18. A base section for a cabinet as recited in claim 17, wherein said biasing means is a coil spring, said coil spring being mounted over said distal end of said actuating member.

19. A base section for a cabinet as recited in claim 18, wherein the actuator defines a portion of the exterior of said base section, the actuating member is shaped as a rod and extends through said front panel, and said coil spring is received between an inner surface of said actuator and said front panel.

* * * * *

UNITED STATES PATENT AND TRADEMARK OFFICE

CERTIFICATE OF CORRECTION

PATENT NO. : 5,417,486

DATED : May 23, 1995

INVENTOR(S) : James Manlove

It is certified that error appears in the above-indentified patent and that said Letters Patent is hereby corrected as shown below:

On the title page, the following information should be inserted with respect to the assignee: --White Consolidated Industries. Inc.. Cleveland, Ohio--.

On the title page, the following information should be inserted with respect to the Attorney, Agent or Firm: --Pearne, Gordon, McCoy & Granger--.

Signed and Sealed this

Ninth Day of April, 1996

Bruce Lehman

*Attest:*

BRUCE LEHMAN

*Attesting Officer*

*Commissioner of Patents and Trademarks*